United States Patent [19]

Ellis et al.

[11] 4,242,382

[45] Dec. 30, 1980

[54] PRODUCTION OF MODIFIED CONJUGATE FIBRE PRODUCTS

[75] Inventors: Vincent S. Ellis; Kazimierz W. Mieszkis, both of Pontypool, England

[73] Assignee: Imperial Chemical Industries Limited, London, England

[21] Appl. No.: 909,820

[22] Filed: May 26, 1978

Related U.S. Application Data

[60] Continuation of Ser. No. 607,947, Aug. 26, 1975, abandoned, which is a division of Ser. No. 351,612, Apr. 16, 1973, abandoned, which is a continuation-in-part of Ser. No. 297,392, Oct. 13, 1972, abandoned.

[30] Foreign Application Priority Data

May 12, 1973 [GB] United Kingdom ..... 11803/73

[51] Int. Cl.[2] ..... B05D 3/02

[52] U.S. Cl. ..... 427/379; 156/62.2; 427/180; 427/185; 427/202; 427/205; 427/375; 427/376.1; 427/376.2; 427/434.2; 428/372

[58] Field of Search ..... 427/185, 204, 205, 202, 427/180, 372 R, 379, 376 R, 376 A, 434 R; 428/372, 281; 156/62.2, 62.4

[56] References Cited

U.S. PATENT DOCUMENTS

| | | | |
|---|---|---|---|
| 2,566,441 | 9/1951 | Camras | 427/205 X |
| 2,845,962 | 8/1958 | Bulgin | 427/122 X |
| 2,907,671 | 10/1959 | Duvivier | 427/205 X |
| 3,037,885 | 6/1962 | Abolins | 427/204 X |
| 3,121,642 | 4/1964 | Biskup | 427/205 |
| 3,140,195 | 7/1964 | Nagel | 427/185 |
| 3,261,090 | 7/1966 | Young | 427/204 X |
| 3,399,070 | 8/1968 | Scharf | 427/205 X |
| 3,492,142 | 1/1970 | Sanders et al. | 427/204 |
| 3,520,766 | 7/1970 | Newman | 428/281 |
| 3,579,409 | 5/1971 | Shannon | 427/204 X |
| 3,586,597 | 6/1971 | Okuhashi | 427/205 X |
| 3,589,956 | 6/1971 | Kranz et al. | 156/62.4 |
| 3,658,626 | 4/1972 | Berger et al. | 156/62.2 X |
| 3,669,736 | 6/1972 | Fujiwara et al. | 428/372 X |
| 3,733,215 | 5/1973 | Paesschen | 427/204 |
| 3,823,035 | 7/1974 | Sanders | 427/122 X |
| 3,998,988 | 12/1976 | Shimomai et al. | 428/372 X |

*Primary Examiner*—Shrive P. Beck

*Attorney, Agent, or Firm*—Cushman, Darby & Cushman

[57] ABSTRACT

A modified conjugate fibre product is formed by applying a predetermined amount of finely-divided particles to a conjugate fibre product and heating the product in an open, substantially tensionless condition at a non-sticking temperature (as defined) for 2 to 40 minutes. By this method, the particles penetrate into the fibre product without inter-fibre sticking taking place.

6 Claims, 10 Drawing Figures

PRODUCTION OF MODIFIED CONJUGATE FIBRE PRODUCTS

This is a continuation of application Ser. No. 607,947, filed Aug. 26, 1975, which is a division of Ser. No. 351,612, filed Apr. 16, 1973, which is a continuation-in-part of Ser. No. 297,392, filed Oct. 13, 1972, all now abandoned.

The present invention relates to the production of modified conjugate fibre products, including tows, yarns, slivers, rovings and non-woven batts. The term "fibre(s)" as used herein is meant to include both staple fibre(s) and continuous filaments(s).

By the expression "conjugate fibre" as used in this specification, is meant a melt spun fibre composed of at least two fibre-forming polymeric components arranged in distinct zones across the cross-section of the fibre and substantially continuous along the length thereof, and wherein one of the components has a melting temperature significantly lower than the melting temperature(s) of the other components and is located so as to form at least a portion of the peripheral surface of the fibre. Types of conjugate fibres within this definition, for example, include those wherein a component of low melting temperature is (I) one of two components arranged side-by-side, or (II) forms a sheath about another component serving as a core, or (III) forms one or more lobes of a multilobal fibre.

Such conjugate fibrs have been modified, in terms of the modification of the chemical and/or physical properties of the fibres, by treating the fibres with particles of matter which, upon the application of heat, penetrate and impregnate the outer surface of the component of lower melting point of the fibres. Such fibres are described for example in U.K. Pat. No. 1,408,082. Each conjugate fibre is modified individually prior to being assembled into a tow or a yarn, for example. This procedure is necessitated because the modification treatment used would otherwise cause sticking of the fibres if the treatment were applied to an assembly of fibres. A significant degree of sticking can result in poor physical properties in continuous filament yarns, for example, in terms of flexibility and handle, and in staple fibres it can give rise to processing problems, for example, during carding.

The present invention seeks to provide a method of modifying a product composed of oriented conjugate fibres wherein particles are penetrated into the surface of the lower melting temperature component without significant sticking between fibres occurring.

According to one aspect of the present invention, a method for the manufacture of a modified conjugate fibre product (as herein defined) comprises applying a predetermined amount of particles substantially uniformly to a conjugate fibre product and heating the product in an open, substantially tensionless condition at a nonsticking temperature for 2 to 40 minutes, the non-sticking temperature lying below and to within at least 1° C. of the curve AB of FIG. 1 (determined as hereinafter defined) of the accompanying drawings.

By the term "open" is meant that the conjugate fibres in the product are relatively disposed such that the possibility of interfibre restraining forces is kept to a minimum. By way of illustration in the case of a tow of continuous filaments care should be taken to ensure that any dampness of the tow is minimal, prior to the heat treatment, in order that the filaments are not cohered. The chances of interfilament restraining forces creating sufficient pressure, during the heat treatment when the filaments are liable to shrink, to cause filament sticking at a normally non-sticking temperature need to be minimised. In other words, steps should be taken to ensure that the product is dry, that is containing less than 0.5% by weight of water, and free from other agents which might create undue coherency.

Figure 1:
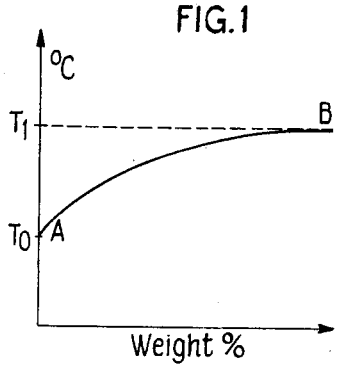
FIG. 1 illustrates the line AB as being a plot of the inter-fibre sticking temperature (as hereinafter defined) of a conjugate fibre product against the percentage by weight of the particles on said product prior to the heat treatment.

FIG. 1 is a plot of sticking temperature against the percentage by weight of the particles on the conjugate fibre product prior to the heat treatment, in respect of a given low melting point component into which the particles are penetrated. To is the sticking temperature of the low melting point component. Surprisingly, the method of the invention is workable above the temperature To without sticking of the fibres, enabling greater and faster penetration of the particles into the low melting point component of the conjugate fibres and therefore it is preferable to work above this temperature.

According to a preferred aspect of the present invention, the non-sticking temperature lies within the area AXCA of FIG. 2 (determined as hereinafter defined) of the accompanying drawings and within at least 1° C. of the curve AB.

Figure 2:
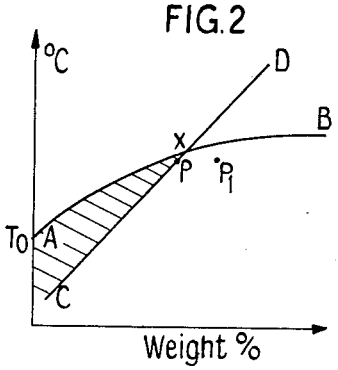
FIG. 2 illustrates, in addition to line AB, a line CD as being a plot of the total amount of the particles which is adsorbed into the conjugate fibre product at the temperature of the heat treatment.

The line CD in FIG. 2 is a plot of the total amount of the particles which is adsorbed into the given low melting point component against the treatment temperature. The line CD enables the prediction to be made of the amount of particles which will actually be penetrated into the fibres of the product and the amount remaining only loosely attached, from a knowledge of the initial amount of particles applied to the product. It is preferable that the line CD should be as steep as possible (relative to the horizontal as viewed in FIG. 2) otherwise the variation in amount of the penetrated particles with temperature is large, and the production of a precisely controlled product may be rendered more difficult.

For a given amount of particles initially applied to the conjugate fibre product, e.g. a tow, a treatment temperature below the line A B of FIG. 1 results in a particle modified product without significant fibre sticking, if any, having occurred. Utilising conditions within the area AXCA yields a "clean" non-stuck product, whereas utilising conditions within the area below the line AB and to the right of the line CD (as viewed in FIG. 2) yields a "dirty" non-stuck product. A "clean" product implies that substantially the whole of the predetermined amount of particles initially applied to the product is firmly attached to and at least partly penetrating the low temperature component of the conjugate fibres. A "dirty" product implies that an excess of the predetermined amount of particles remains unattached on the surface of the product.

The treatment temperature preferably lies 1° C. to 2° C. below the line AB in order to provide for non-sticking of the conjugate fibres and maximum particle adsorption and/or speed of processing. In practice, a preferred operating point for the manufacture of "clean" products is designated P in FIG. 2, which point lies on the line CD and is 1° C. to 2° C. below the point of intersection of the lines AB and CD. Transposition of the operating point to $P_1$ in FIG. 2 will result in the manufacture of a "dirty" product should this be desired.

The precise shape and the relative positions of the lines AB and CD vary with the nature of the polymeric material of the low melting point component of the conjugate fibre and the nature of the particles of matter. These factors of shape and relative positions can be affected by other influences, e.g. the application of pressure to the fibre/particle system, and the effect of such influences require to be taken into account when the lines AB and CD are being determined.

The particle size of the added material affects the rate of ingress into the conjugate fibres, the amount of adsorption being virtually completed in 2 to 40 minutes, depending on the nature of the low melting point component and the treatment temperature. Generally, however, for particles less than 0.1 micron average particle size completion of the adsorption process takes less than 10 minutes, and for particles in the range 0.1 micron to 0.5 micron average particle size the time taken is about 30 minutes. For the method of the invention, the preferred average particle size is less than 1 micron, preferably less than 0.5 micron. The "average particle size" indicates the largest cross-section dimension of a particle, e.g. the diameter in the case of a spherical particle. A wide range of particles is suitable for use in the present method, and includes, by way of example, luminous particles, electrically conductive particles (e.g. carbon black), metal oxides, colourants, phosphorescent particles, water repellant particles, and siliceous earths.

The polymeric material of the low melting point component has a melting point at least 10° C. below that of the other component of the conjugate fibre. Hereinafter, the former component will be referred to as the "sheath" component and the latter component as the "core" component, since the preferred conjugate fibre for use in the invention is the sheath/core fibre of type (III). Preferably, the melting point of the sheath is at least 20° C. below that of the core. The temperature difference is a safeguard ensuring that the core of the conjugate fibres of the product is not unduly impaired by the heat treatment used to achieve particle penetration of the sheath.

Figure 3:
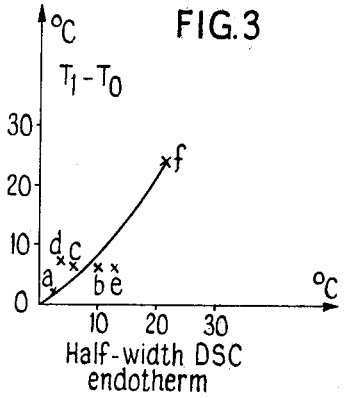
FIG. 3 illustrates the relationship between the temperature difference $T_1-T_0$ (of FIG. 1) and the half-width of the DSC melting endotherm of a range of low melting point polymer components of conjugate fibre products.

Furthermore, it is desirable that the temperature difference Ti−To (see FIG. 1) should be as large as possible for easier operation of the method as it allows operation at a temperature within the range 1° C. to 2° C. below the line AB to be significantly high compared with the sticking temperature To of the untreated conjugate fibres. Consequently, the preferred sheath polymers should have a wide softening range. The relationship between the temperature difference Ti−To and the half-width of the DSC melting endotherm (as hereinafter defined) of the sheath polymer for a range of such polymers, is given in FIG. 3 of the accompanying drawings. The key to the sheath polymers is as follows:

a poly(ethylene terephthalate)
b polycaprolactam (nylon 6)
c polyethylene
d copolymer of poly(ethylene terephthalate) with 5 mole % of poly(ethylene isophthalate)
e copolymer of poly(ethylene terephthalate) with 10 mole % of poly(ethylene isophthalate)
f copolymer of poly(ethylene terephthalate) with 20 mole % of poly(ethylene adipate)

It is therefore preferred that the half-width of the DSC melting endotherm should be at least 5° C., more preferably greater than 10° C. This requirement is not to be considered as an absolute rule, but rather as a guide to facilitate the selection of a suitable sheath polymer. In practical terms, the net result of the two limitations on the thermal properties of the sheath polymer means that copolymers are generally preferable to homopolymers.

The method of the invention is particularly applicable to conjugate fibre products in the form of continuous filament yarns, or tows which are to be particle-modified prior to conversion into staple fibres. A predetermined amount of particles is initially applied to the tow by treating the tow in an agitated bed of fluidised particles or, more preferably, in a liquid in which the particles are dispersed. The conjugate filament tow is composed of oriented conjugate filaments which have been subjected to a drawing process to enhance their mechanical properties. In the case in which the particles are applied utilising a liquid dispersion, care should be taken to remove as much of the liquid as possible to leave a dry, open tow. This may be achieved by passing the tow through a pair of nip rolls to remove excess liquid and then over a series of heated rolls.

The conjugate filament tow may be crimped prior to or after being subjected to the method of the present invention.

DETERMINATIONS AND DEFINITIONS

1. Inter-fibre Sticking Temperature is determined in the following manner:

Two sample lengths of a tow containing at least 200 conjugate continuous filaments (as hereinbefore defined) are taken. An aluminum strip 3.5 in.×3 in×0.002 in. is bent into a U-shape section with side pieces of equal length. The two tow samples are then laid so as to give an overlap of 2.5 in. on the base of the U-shape section, whereafter the side pieces are folded over to enclose the overlapping sample and the whole assembly is pressed between two pieces of glass plate for one minute using a 5 Kg. weight. At least 8 samples are prepared in this manner.

One sample is used as a control and is tested on an Instron (R.T.M.) Tester with a traverse rate of 10 cm./minute and the force required to part the overlapping tow samples noted. The remaining samples are then heated for ten minutes at controlled temperatures, say 10° C., 20° C., 30° C., for example, below the known melting point of the low melting point component of the conjugate filaments. The samples are then tested on th Instron (R.T.M.) and the results compared with that of the control. An increase by a factor of 2 in the force noted is taken as an indication that some sticking has occurred. The sticking temperature, To, is known to the nearest 10° C., and is determined more accurately by further testing within this 10° C. range.

2. Determination of the Line AB

Several sample hanks of a tow of oriented conjugate fibres have particles applied thereto so that each hank is coated with an amount which differs from each other hank. Each amount is known and is obtained by treating the hanks with varying concentrations, e.g. 10%, 7.5%, 5.0%, 2.5%, 1.0%, all by weight, of particles in an aqueous dispersion. Each hank is then completely dried, divided in two portions, and one portion is weighed, washed in running water and detergent to remove all the particles, dried and re-weighed, to obtain the amount in weight percent of the particles which was on the surface of the fibres. The remaining portions are each then subjected to the test for determining sticking temperature and the line AB plotted beginning with the temperature To.

3. Determination of the Line CD

A dry hank of oriented conjugate fibres having a known weight percent coating of the particles is heated for ten minutes at a given temperature which is 2° C. below the sticking temperature of the coated conjugate fibres of the hank (previously determined). The hank is then washed thoroughly to remove excess, non-adsorbed particles and dried. The amount of adsorbed particles in the fibres of the hank is obtained by weight difference or by dissolving the fibres and weighing the remaining particles which are filtered off. The same procedure is repeated on identical hanks over a wide range of temperatures below the given temperature already used. The various amounts of adsorbed particles obtained are plotted against their respective temperatures to obtain the line CD. 4. D.S.C. Melting Endotherm (half-width)

Figure 4:
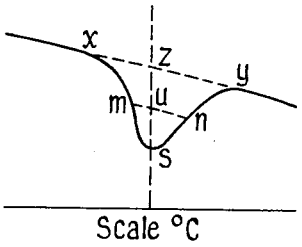
FIG. 4 is an illustration of a DSC melting endotherm of the low melting point component of a conjugate fibre product.

The Differential Scanning Calorimeter melting endotherm (see FIG. 4 of the accompanying drawings) of the low melting point component of the oriented conjugate fibre, is obtained using 5 to 10 milligrams of the fibre in a Perkin-Elmer D.S.C.IB heated at a rate of 16° C./minute. The half-width value is determined by:

(i) draw in the background curve xy (ii) draw the perpendicular through the peak s which meets xy at z.

(iii) measure the mid-point u between s and z.

(iv) draw the line mn through u parallel to xy.

(v) measure mn, the half-width in °C.

The invention will be further described by way of illustration with reference to the following Examples.

EXAMPLE 1

A 1600 decitex drawn yarn was made consisting of 700 concentric sheath/core conjugate filaments each of which had a poly(ethylene terephthalate) core of intrinsic viscosity 0.675 and a sheath derived from a copolyester, intrinsic viscosity 0.675, containing 80% by weight ethylene terephthalate units and 20% by weight ethylene adipate units. The weight ratio of sheath to core was 1:2.

The sticking temperature, To, was determined as hereinbefore described and was found to be 176° C.

The drawn yarn was passed into a bath containing a slurry of an aqueous dispersion of 10% by weight carbon black particles (Vulcan XC-72R, Cabot Carbon primary particles size 0.03 microns) and 1% by Lomer D (Nopco-Hess), a naphthalene sulphonate condensate. The slurry had been ball-milled for 4 hours prior to use. The yarn was passed through a driven nip roll to squeeze off excess liquid, completely dried over four driven heated rolls maintained at 150° C., and collected on a wind-up machine at 50 feet per minute. The amount of carbon carried by the yarn was determined by weighing a ten feet length sample of the yarn, washing the sample free of carbon in running water and detergent, drying the sample and finally reweighing. The amount of carbon present was found to be 4% by weight. Another sample of the yarn carrying this amount of carbon as a coating was subjected to the sticking temperature determination, and the sticking temperature was found to be 197° C.

Samples of the drawn yarn were coated with different percentage weights of the carbon black particles, by varying the concentration of the slurry, that is 7.5% by weight, 5.0% by weight, 2.5% by weight, and 1.0% by weight. The sticking temperature was determined for each sample. Thereafter, the line AB was plotted (see FIG. 5 of the accompanying drawings).

A sample of the yarn coated with 4% by weight carbon black was placed in a heating apparatus for 10 minutes at 195° C. The sample was removed and thoroughly washed to free all the excess carbon present of the surfaces of the filaments. The amount of the carbon black particles which had been adsorbed into the sheaths was determined by boiling 3 to 4 grams of the washed sample in 80 ml. diethylene glycol and 0.1 gm. zinc acetate hydrate and weighing the amount of remaining carbon after filtering it off. 2.6% by weight carbon black was found to have been adsorbed. This procedure was repeated on identical samples at temperatures in the range 170° C. to 195° C. From the results obtained, the line CD of FIG. 5 was plotted.

Further samples were subjected to the same procedure at temperatures of 174° C., 185° C., and 196° C., and the dwell time in the heating apparatus at each temperature was varied between 2, 5, 10 and 20 minutes. The amount of adsorbed particles with time at each temperature is illustrated by the dotted lines in FIG. 10 of the accompanying drawings.

Figure 5:
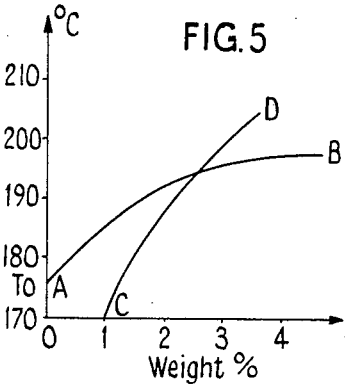
FIGS. 5 to 9 inclusive are specific illustrations of FIG. 2 and are identified in the appropriate examples.

To demonstrate the utility of the curves AB and CD of FIG. 5, a drawn yarn was treated in accordance with Example 1 so that 1.5% by weight of carbon black was carried on the filament surfaces. Samples of the yarn were then treated thus:

(a) A dry sample of the yarn was heated under substantially tensionless conditions at 192° C. for 10 minutes. Inspection showed that the filaments were stuck together, and on washing the evidence of very little carbon being present in the water showed that the carbon particles had been adsorbed into the sheaths of the filaments of the yarn sample. Result: stuck, "clean" product.

(b) The procedure in (a) was repeated on samples of the yarn at temperatures in the range 182° C. to 188° C. None of the samples exhibited stuck filaments and little carbon, if any, was present in the water used to wash the samples. Result: non-stuck, "clear" products.

(c) The procedure in (a) was repeated on a sample of the yarn at 178° C. No filament sticking was evident, but after washing, the washing water was visibly coloured by carbon black particles. Result: non-stuck, "dirty" product.

EXAMPLE 2

A 1600 decitex drawn yarn was made consisting of 700 concentric sheath/core continuous conjugate filaments, each of which was composed of a core of poly(ethylene terephthalate), intrinsic viscosity 0.675, and a sheath derived from a copolyester containing 90% by weight ethylene terephthalate units and 10% by weight of ethylene isophthalate units. The intrinsic viscosity of the copolyester was 0.675. The weight ratio of the sheath to the core was 1:2.

The D.S.C. melting endotherm curve of the sheath component was obtained to serve as a guide in determining the range of temperatures to be utilized in obtaining the data for the lines AB and CD.

Figure 8:
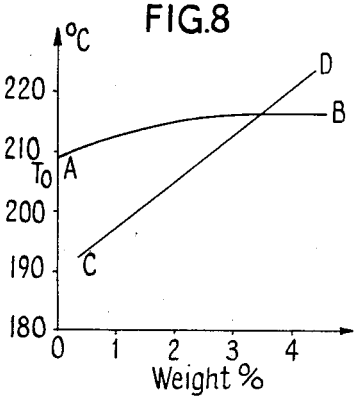

The yarn was treated with carbon black particles in the manner described in Example 1, and the same procedures were followed to obtain the lines AB and CD illustrated in FIG. 8 of the accompanying drawings.

EXAMPLE 3

An 850 decitex drawn yarn was made consisting of 350 sheath/core continuous conjugate filaments each of which had a polyhexamethylene adipamide (Nylon 6.6) core, relative viscosity 35, and a poly-caprolactam (Nylon 6) sheath, relative viscosity 35.

Figure 9:
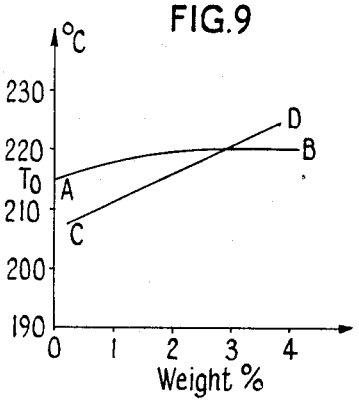

The yarn was treated with carbon particles as described in Example 1 and then like procedures followed for the determination of the lines AB and CD, as illustrated in FIG. 9 of the accompanying drawings, with the exception that the amount of adsorbed carbon was found by dissolving a 3 to 4 gram sample of the yarn is 80 ml. boiling hydrochloric acid (1:1::HCl:Water).

EXAMPLE 4

Figure 6:
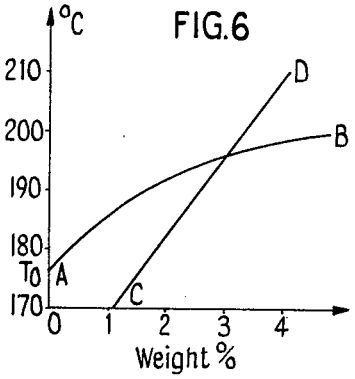

The drawn yarn of Example 1 was passed through a slurry of an aqueous dispersion of silica containing 7.5% by weight Wessalon S (I.D. Chemicals, primary particle size 0.02 microns) and 0.75 by weight Lomar D (Napco-Hess), a naphthalene sulphonated condensate. The slurry had been ball-milled for four hours prior to use. The same procedures were then carried out as described in Example 1. The resulting plots of lines AB and CD are illustrated in FIG. 6 of the accompanying drawings.

EXAMPLE 5

Figure 7:
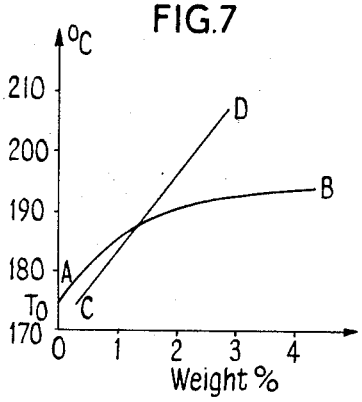

The drawn yarn of Example 1 was passed through a slurry of an aqueous dispersion of 20% by weight of titanium dioxide (Kronos AD, primary particle size 0.3 microns), which had been ball-milled for 12 hours prior to use. The same procedure were then carried out as described in Example 1. The resulting plots of lines AB and CD are illustrated in FIG. 7 of the accompanying drawings.

Figure 10:
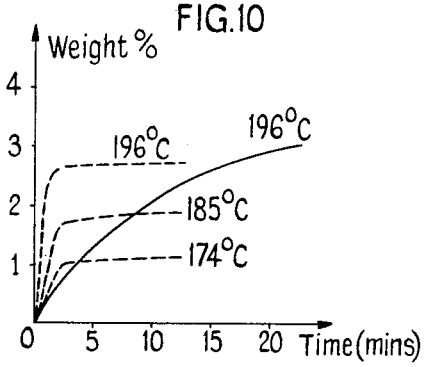
FIG. 10 illustrates the relationship between amount of particles adsorbed with time at different temperatures.

The change in the amount of adsorbed titanium dioxide particles into the filament sheaths with time, at a temperature of 196° C., was determined as in Example 1 and is illustrated by the full-line curve in FIG. 10.

EXAMPLE 6

Three drawn yarns of substantially the same decitex and number of filaments were made.

Yarn A was composed of sheath/core conjugate filaments each with core of poly(ethylene terephthalate), intrinsic viscosity 0.675, and a sheath of an 80:20 by weight copolymer of poly(ethylene terephthalate/adipate), intrinsic viscosity 0.420.

Yarns B and C differed from Yarn A by having their sheath components having intrinsic viscosities of 0.675 and 0.910, respectively.

The yarns were treated with carbon particles in accordance with Example 1 and the amount of carbon retained by each yarn at a treatment temperature of 194° C. was determined in accordance with that Example. The results are given in Table I.

The sticking temperature for each yarn was determined with 3.5% by weight carbon black particles present on the filaments. The results are given in Table II.

TABLE I

| | Intrinsic Viscosity | % by Weight Carbon |
|---|---|---|
| Yarn A | 0.420 | 3.3 |
| Yarn B | 0.675 | 2.5 |
| Yarn C | 0.910 | 1.3 |

TABLE II

| | Intrinsic Viscosity | Sticking Temp. °C. |
|---|---|---|
| Yarn A | 0.420 | 196 |
| Yarn B | 0.675 | 197 |
| Yarn C | 0.910 | 203 |

The measurement of the intrinsic viscosities of the polyesters referred to herein were measured in orthochlorophenol at 25° C., and the measurement of the relative viscosities of the polyamides referred to herein were measured using an 8.4% solution in 90% formic acid at 25° C.

What we claim is:

1. A method of modifying a conjugate fibre product containing a plurality of melt spun conjugate fibres each composed of at least two fibre-forming polymer components arranged in distinct zones across the cross-section of the fibre and substantially continuous along the length thereof, one of the components having a melting temperature significantly lower than the melting temperature of the other component and being located so as to form at least a peripheral surface of the fibre, said method comprising:

(a) applying a predetermined amount of particles of average size less than one micron substantially uniformly to a conjugate fibre product composed of said fibres by treating the product in a liquid in which the particles are dispersed:

(b) removing excess liquid and drying the product so as to leave the product in a dry, open, substantially tensionless condition; and (c) heating the product in said condition at a non-sticking temperature for 2 to 40 minutes so as to cause substantially the whole of said particles to penetrate and become virtually completely adsorbed into the lower melting component, the non-sticking temperature lying within the Area AXCA of FIG. 2, but above the temperature To and at least 1° C. below the curve AB, to product a clean, non stuck, modified, conjugate fibre product.

2. A method according to claim 1, wherein the conjugate fibre product is a tow of continuous conjugate filaments and the particles applied thereto are particles of carbon black.

3. A method according to claim 1 wherein the operating conditions are designated by a point which lies on the line CD of FIG. 2 and is 1° C. to 2° C. below the point of intersection of the lines AB and CD.

4. A method according to claim 1 wherein the conjugate fibres are bicomponent fibres.

5. A method of claim 4, characterised in that the polymeric material of the lower melting point component of the conjugate fibres has a melting point at least 10° C. below that of the other component.

6. A method according to claim 4, characterised in that the polymeric material of the lower melting point component of the conjugate fibres has a melting point at least 20° C. below that of the other component.

* * * * *